United States Patent [19]

Oxley et al.

[11] Patent Number: 4,667,642

[45] Date of Patent: May 26, 1987

[54] COMBUSTION ENGINE FUEL DELIVERY SYSTEM

[76] Inventors: Phillip H. Oxley, 4 Carthona Avenue, Darling Point, New South Wales 2027; Alan T. Woods, 12 Mackey Street, Surry Hills, New South Wales 2010, both of Australia

[21] Appl. No.: 723,878

[22] Filed: Apr. 17, 1985

[30] Foreign Application Priority Data

Apr. 17, 1984 [AU] Australia ..... PG4627

[51] Int. Cl.[4] ..... F02M 31/02

[52] U.S. Cl. ..... 123/557; 123/447

[58] Field of Search ..... 123/557, 558, 525, 552, 123/447

[56] References Cited

U.S. PATENT DOCUMENTS

| | | | |
|---|---|---|---|
| 595,497 | 12/1897 | Rowbotham | 123/557 |
| 2,150,764 | 3/1939 | Farineay | 123/525 |
| 2,219,522 | 10/1940 | Hinsch | 123/558 |
| 2,339,988 | 1/1944 | Gerson | 123/525 |
| 3,306,273 | 2/1967 | Dolphin | 123/557 |
| 3,361,353 | 1/1968 | Millman | 123/558 |
| 3,738,334 | 6/1973 | Farr | 123/557 |
| 4,372,264 | 2/1983 | Trucco | 123/557 |

FOREIGN PATENT DOCUMENTS

| | | | |
|---|---|---|---|
| 58-872671 | 4/1983 | Japan | 123/557 |

*Primary Examiner*—Charles J. Myhre
*Assistant Examiner*—David A. Okonsky
*Attorney, Agent, or Firm*—Ladas & Parry

[57] ABSTRACT

A fuel system for an internal combustion engine, the fuel system includes a delivery chamber to which fuel under pressure is delivered and then heated prior to being exposed to the combustion chamber of the engine.

4 Claims, 2 Drawing Figures

COMBUSTION ENGINE FUEL DELIVERY SYSTEM

The present invention relates to internal combustion engines and more particularly to a fuel system for an internal combustion system.

Conventional internal combustion engines have the disadvantage that they very inaccurately approximate the Otto cycle. More particularly, known internal combustion engines do not provide the adiabatic expansion in the combustion cylinder required for maximum efficiency of the Otto cycle. The end result is that heat is wasted and accordingly these known internal combustion engines are not fuel efficient.

It is the object of the present invention to overcome or substantially ameliorate the above disadvantages.

There is disclosed herein a fuel delivery system for an internal combustion engine, said system comprising a fuel delivery chamber, a first duct extending to said delivery chamber and through which fuel under pressure passes to be delivered to said delivery chamber, first valve means to govern the delivery of fuel to said delivery chamber, a second duct extending from said delivery chamber to a combustion chamber of the engine, second valve means to selectively close said second duct in co-ordination with said first valve means, and heater means to heat fuel delivered to said delivery chamber prior to being exposed to said combustion chamber by said second valve means.

Figure 2:
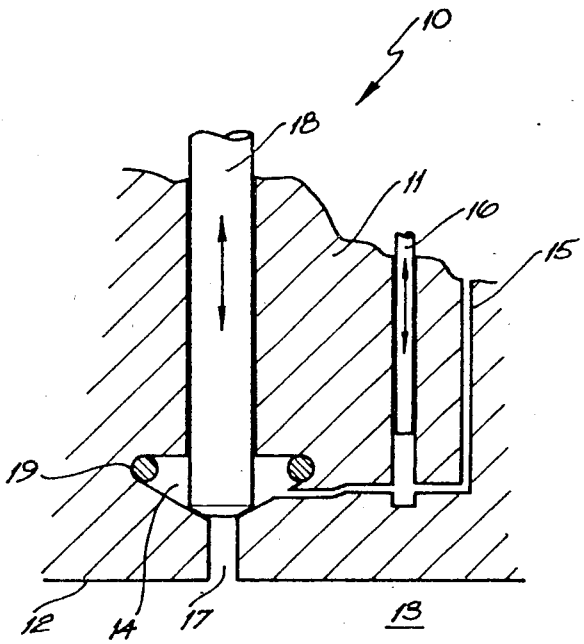
Figure 1:
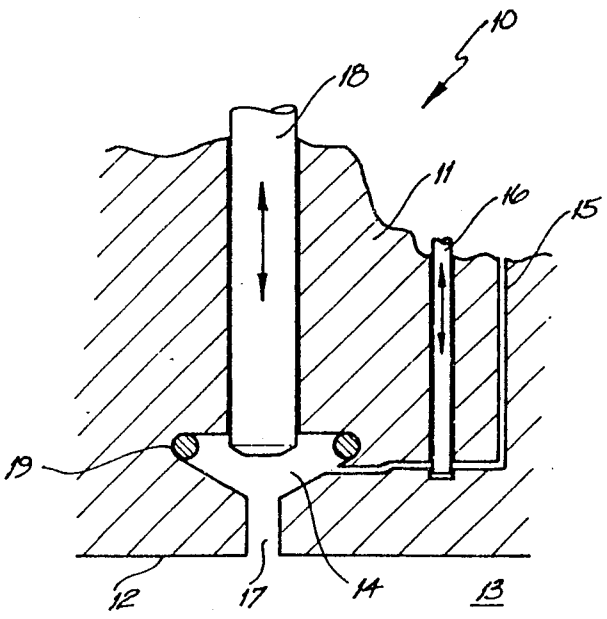

A preferred form of the present invention will now be described by way of example with reference to the accompanying drawings wherein:

FIG. 1 is a schematic sectioned side elevation of a fuel delivery system for an internal combustion engine; and FIG. 2 is a schematic sectioned side elevation of the fuel system of FIG. 1 in a different operating configuration.

In FIGS. 1 and 2 there is schematically depicted a fuel delivery system 10 for an internal combustion engine. The system 10 includes a main body 11 which has an inner wall 12 which would cooperate with other portions of the motor to define a combustion chamber 13. Formed in the body 11 is a cavity 14 to which liquid fuel under pressure is delivered by means of a first passage 15. Flow of liquid fuel to the cavity 14 is governed by a movable valve member 16 which selectively permits fuel under pressure to pass from the passage 15 to the cavity 14.

Extending from the cavity 14 is a second passage 17 which is selectively closed by a second movable valve member 18 slidably received in the body 11. In FIG. 1, the second movable valve member 18 is in a position allowing communication between the cavity 14 and the combustion chamber 13. It should also be noted that the movable member 16 is blocking the passage 15. In FIG. 2 the movable valve member 18 is closing the passage 17 while the movable valve member 16 is allowing fuel under pressure to be delivered via the passage 15 to the cavity 14.

Located in the cavity 14 is a heated element 19 which heats the liquid fuel delivered thereto.

In operation of the abovedescribed system 10, fuel under pressure is first delivered to the cavity 14 via the passage 15. Thereafter the movable valve member 16 closes the passage 15 and the movable valve member 18 opens the passage 17 so that the now heated fuel in the cavity 14 is exposed to the combustion chamber 13.

Preferably the body 11 would be formed of a material which would withstand temperatures applied to the cavity 14 by the heating element 19. It has been found advantageous to form the body 11 of a partially stabilised zirconia known as "Nilcra-PSZ". This Nilcra-PSZ is sold by Nilcra Ceramics Pty Limited of Melbourne, Australia.

It should be appreciated that in operation of the abovedescribed system 10 that the movable valve members 16 and 18 are co-ordinated so that the movable valve member 16 closes the passage 15 whenever the passage 17 is opened by the movable valve member 18.

The above-described fuel system 10, has the advantage that the fuel delivered to the combustion chamber 13 is preheated to such an extent that the combustion within the chamber 13 will more closely approximate an adiabatic expansion thereby increasing the efficiency of the engine. This is achieved by heating the fuel in the cavity 14 so as to cause vapourization thereof upon opening of the passage 17.

What we claim is:

1. A fuel delivery system for an internal combustion engine, said system comprising a fuel delivery chamber of a constant volume, a first duct extending to said delivery chamber and through which fuel under pressure passes to be delivered to said delivery chamber, first valve means to govern the delivery of fuel to said delivery chamber, a second duct providing direct communication between said delivery chamber and a combustion chamber of the engine, second valve means to selectively close said second duct in coordination with said first valve means so that said second valve means is closed when said first valve means is open and said first valve means is closed when said second valve means is open, and heater means to heat fuel delivered to said delivery chamber to achieve complete vapourization of said fuel prior to being exposed to said combustion chamber by said second valve means.

2. The fuel delivery system of claim 1 further including means to deliver fuel under pressure to said first duct.

3. The fuel delivery system of claim 1 wherein said chamber has a peripheral surface formed of partially stabilized zirconia.

4. The fuel delivery system of claim 1 wherein said heater means is located within said delivery chamber.

* * * * *